US007104318B2

(12) United States Patent
Hendrie

(10) Patent No.: US 7,104,318 B2
(45) Date of Patent: Sep. 12, 2006

(54) SELF-CONTAINED CENTRALIZER SYSTEM

(75) Inventor: Craig Hendrie, Houston, TX (US)

(73) Assignee: Plexus Ocean Systems, Ltd., (GB)

( * ) Notice: Subject to any disclaimer, the term of this patent is extended or adjusted under 35 U.S.C. 154(b) by 215 days.

(21) Appl. No.: 10/819,778

(22) Filed: Apr. 7, 2004

(65) Prior Publication Data

US 2005/0224227 A1 Oct. 13, 2005

(51) Int. Cl.
*E21B 23/04* (2006.01)

(52) U.S. Cl. ..... 166/241.1; 166/241.4

(58) Field of Classification Search ... 166/241.1–241.7
See application file for complete search history.

(56) References Cited

U.S. PATENT DOCUMENTS 5,655,609 A * 8/1997 Brown et al. ..... 175/76
6,343,657 B1 * 2/2002 Baugh et al. ..... 166/383
6,561,280 B1 * 5/2003 Baugh et al. ..... 166/383
6,629,568 B1 * 10/2003 Post et al. ..... 166/382

* cited by examiner

*Primary Examiner*—Frank S. Tsay
(74) *Attorney, Agent, or Firm*—Jackson Walker L.L.P.; Mark A. Tidwell, Esq.

(57) ABSTRACT

A centralizer assembly for centralizing casing inside a riser includes a locking element to move generally radially outward from the casing toward the riser in response to a change in pressure in the annulus between the casing and the riser. The locking element may be a first wedge shaped element adapted for movement in a radial direction from the casing toward the riser and a second wedge shaped element adapted to move generally axially along the casing and adapted for engaging the first wedge shaped element in response to a pressure activated driver. The driver may be a rupture device that ruptures when the pressure in the annulus reaches a predetermined threshold. Ratchet teeth are included between the elements for engaging and locking the wedge shaped elements in position once driven by the driver.

20 Claims, 5 Drawing Sheets

SELF-CONTAINED CENTRALIZER SYSTEM

BACKGROUND OF THE INVENTION

1. Field of the Invention

The subject invention relates generally to borehole centralizers and is specifically directed to a self-contained, self-energizing centralizer system.

2. Discussion of the Prior Art

Centralizers are devices used to provide space between an interior member and the walls of a bore hole, thereby maintaining a concentric assembly with a uniform annulus between the interior member and the bore hole wall. The centralizer field includes many different inventions which have attempted to improve the functions of the centralizer. Its two primary functions are to: 1) provide space between the anchorage and the walls of the bore hole, and 2) to provide a locking mechanism for the several centralizer elements so that they do not fail once installed.

In certain oilfield applications, in particular in dual barrier deepwater production risers, it is necessary to rigidly centralize and locate an inner casing string within an outer riser. There may be up to 50 centralizers at various heights up the riser all within the annular space. The centralizers must be kept un-activated while the casing is installed in the riser, to prevent damage and hang-ups on restrictions to the riser bore in the wellhead.

The usual way of achieving this is some sort of hydraulically activated device, where each centralizer is manifolded to a hydraulic line which must exit the annulus at the wellhead so that it can be controlled. This has the disadvantages of a large number of potential leaks, expense and complication of contracting and assembling the system, and potential for causing a leak path later in field life.

Known relevant prior art has focused on improving the locking mechanism. Prior art designs have had some success in overcoming some of the problems inherent with centralizer systems, including inflexibility in meeting multiple applications and relatively complex locking mechanisms. However, the prior art virtually neglects the problem of complex locking systems and the requirement that the lock activator exit the annulus at the wellhead in order to be controlled.

As is well known in the art, the collars of such centralizers normally comprise hingedly connected, arcuate sections which may be opened up for assembly about the casing and then latched to one another in close fitting relation thereabout. The bow springs comprise relatively thin, flexible strips of metal which are bowed outwardly intermediate their ends so as to tightly engage the bore of a well. More particularly, the bow springs are equally spaced apart so as to hold the casing in a generally centered position within the well bore to insure that the column of cement forced into the annulus between the casing and well bore is of substantially uniform thickness. The collars fit closely about the casing, but are free to slide therealong, so that, when the central portions of the bow springs are inwardly compressed by engagement with the well bore, their ends move the collars away from one another.

Many patents including U.S. Pat. No. 6,367,556, U.S. Pat. No. 4,909,322, U.S. Pat. No. 4,651,823, U.S. Pat. No. 4,520,869, U.S. Pat. No. 4,269,269, U.S. Pat. No. 4,077,470 and U.S. Pat. No. 4,042,022 describe a centralizer device which comprise a plurality of spring bows, a method of attaching the bow springs while still allowing flexure, and a method of fixing the centralizer device to a drill-pipe or casing. The bow springs allow the centralizer to pass down into the bore, and pass small irregularities and restrictions in the bore, while still maintaining some centralizing load.

Other patents including U.S. Pat. No. 4,247,225 and U.S. Pat. No. 4,866,903 disclose an alignment devices comprising a fixed portion for the purpose of centralizing a component in a bore. These devices offer a rigid centralization inside a true bore, but cannot pass through small irregularities and restrictions in the bore U.K. Pat. No. GB 2,381,280 describes a centralizer with a plurality of moveable ribs which can be activated to centralize the casing or pipe inside a bore. This device requires manual activation, and moves the ribs out to a position where they are locked in place and functions like a fixed diameter centralizer. It is conceivable that this invention could be converted to use in an annular space by configuring hydraulic cylinders to activate the centralizer mechanism. This has the disadvantage of requiring hydraulic lines between each centralizer device, and a means for exiting the hydraulic control line from the enclosed annular space.

It would be desirable to provide a locking system that can be energized without invading the bore and without requiring extensive energization systems.

SUMMARY OF THE INVENTION

In its broadest sense the subject invention is directed to a centralizer assembly for centralizing an inner tubular member inside the annulus of an outer tubular member, the assembly being mounted on the outer perimeter of the inner tubular member and having a dog or locking element adapted for movement between a first clearance position and a second, extended position wherein the locking element engages the outer tubular member for positioning the inner tubular member relative to the outer tubular member coupled with a driver for moving the locking element from the first clearance position to the second, extended position in response to a change in pressure in the annulus.

Specifically, the subject invention is directed to a simple and cost effective piston and wedge centralizer device, using the pressure in the annulus to activate the system, hence eliminating the requirement for any hydraulic lines in the annulus, or any interconnection between each of a plurality of centralizers.

The centralizer assembly of the subject invention includes a first wedge shaped element adapted to move generally radially outward from the casing toward the riser, a second wedge shaped element adapted to move generally axially along the casing and adapted for engaging the first wedge shaped element and a driver for driving the second wedge shaped element in the axial direction, the driver responsive to a change in pressure in the annulus. A base holds the first wedge and second wedge shaped elements and the driver in assembled relationship. In the preferred embodiment the base is adapted for carrying a plurality of the assembled relationships angularly spaced about the perimeter of the casing.

In the preferred embodiment, the driver is a rupture device that ruptures when the pressure in the annulus reaches a predetermined threshold. The driver is a piston and cylinder assembly, wherein the piston engages and drives the second wedge shaped element upon activation.

Ratchet teeth are provided between the components to lock the wedge shaped elements is position once driven by the driver.

In the preferred embodiment the centralizer assembly of the subject inventions consists of a clamp base assembly which can be bolted in place to attach the entire assembly to the inner casing. The base has a number of ribs attached to it which allow the other component to be conveniently attached in place. A cylinder housing contains an internal piston and rod and a rupture device. The components are assembled at atmospheric pressure such that the pressure on each side of the piston is equal.

Once assembled in place within the riser, the pressure in the annulus is increased past the burst setting pressure of the bursting device (typically about 1,500 psi). This allows fluid from the annulus to rapidly flow into the cavity behind the piston, and since the pressure at the other side of the piston is still at atmosphere, the piston moves rapidly with large force until the pressures are balanced.

This piston activation causes a wedge to be forced under the complementary dog which moves out until its outer edge is in contact with the bore of the riser. The preferred embodiment includes ratchet teeth between the wedge and dog components such that the wedge is irreversibly locked in place, and does not revert to its original position when the annular pressure is reduced, and the piston moves back away from the wedge.

The preferred embodiment uses an array of the piston/wedge assemblies around the circumference of the casing to ensure adequate centralization of the casing within the riser. The piston/wedged assemblies are capped at each end by protectors help guide the assemblies through the well bore while preventing damage.

Therefore, it is an object and feature of the subject invention to provide a simple centralizer having a self-contained energizing and locking system.

It is a further object and feature of the subject invention to provide a centralizer locking system wherein the locking mechanism is irreversibly engaged even in the event of a loss of pressure in the bore.

Other objects and features of the subject will be readily apparent from the accompanying drawing and detailed description of the preferred embodiments.

DETAILED DESCRIPTION OF THE PREFERRED EMBODIMENTS

In its broadest sense, the invention is a centralizer assembly for centralizing an inner tubular member inside the annulus of an outer tubular member, the assembly being mounted on the outer perimeter of the inner tubular member and having a dog or locking element adapted for movement between a first clearance position and a second, extended position wherein the locking element engages the outer tubular member for positioning the inner tubular member relative to the outer tubular member, coupled with a driver for moving the locking element from the first clearance position to the second, extended position in response to a change in pressure in the annulus.

In the preferred embodiment of the invention the locking element is a first wedge shaped element adapted to move generally radially outward from the inner tubular member toward the outer tubular member. A second wedge shaped element is adapted to move generally axially along the inner tubular member for engaging the first wedge shaped element. A driver for driving the second wedge shaped element in the axial direction is responsive to a change in pressure in the annulus. In the preferred embodiment the driver is a pressure relief system responsive to drive the second wedge shaped element when the pressure in the annulus reaches a predetermined threshold. The pressure relief system is a rupture device. The driver is a piston and cylinder assembly, wherein the piston engages and drives the second wedge shaped element upon activation.

Typically, the centralizer assembly includes a base for holding the first wedge and second wedge shaped elements and the driver in assembled relationship. The base is adapted for carrying a plurality of the assembled relationships angularly spaced about the perimeter of the inner tubular member. Ratchet teeth may be included for engaging and locking the wedge shaped elements in position once driven by the driver.

Figure 1:
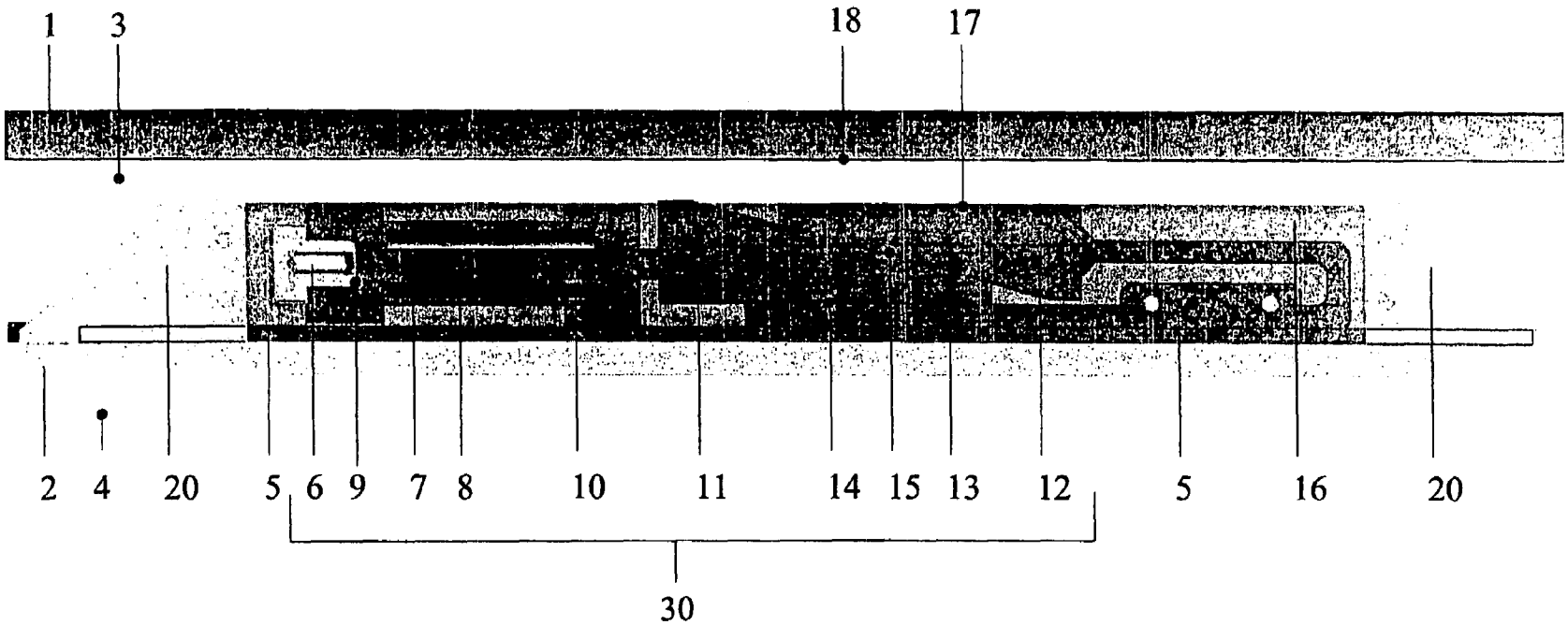
FIG. 1 is a longitudinal, partial section of a well bore assembly including the centralizer system of the subject invention, with the centralizer in the de-energized position.

With reference to FIG. 1, in certain oilfield applications, in particular in dual barrier deepwater production risers, it is necessary to rigidly centralize and locate an inner casing string (2) within an outer riser (1). There may be up to 50 centralizers (30) at various heights up the riser all within the annular space (3). The centralizers (30) must be kept unactivated while the casing (2) is installed in the riser (1), to prevent damage and hang-ups on restrictions to the riser bore in the wellhead.

Figure 2:
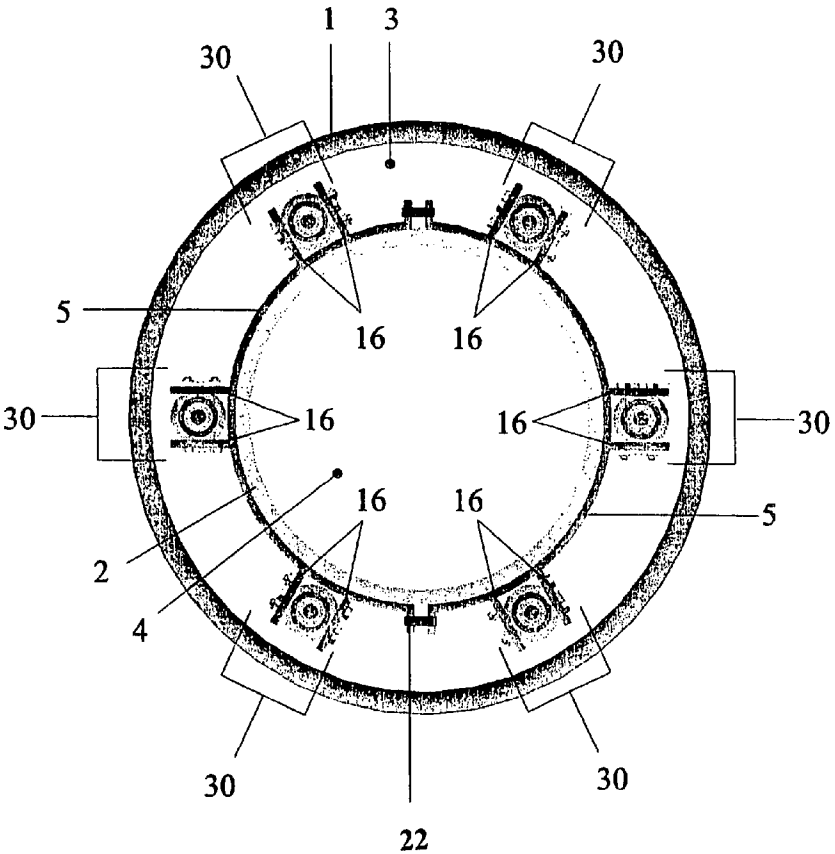
FIG. 2 is a cross-section of the assembly of FIG. 1 through the axis of the bore.
Figure 5:
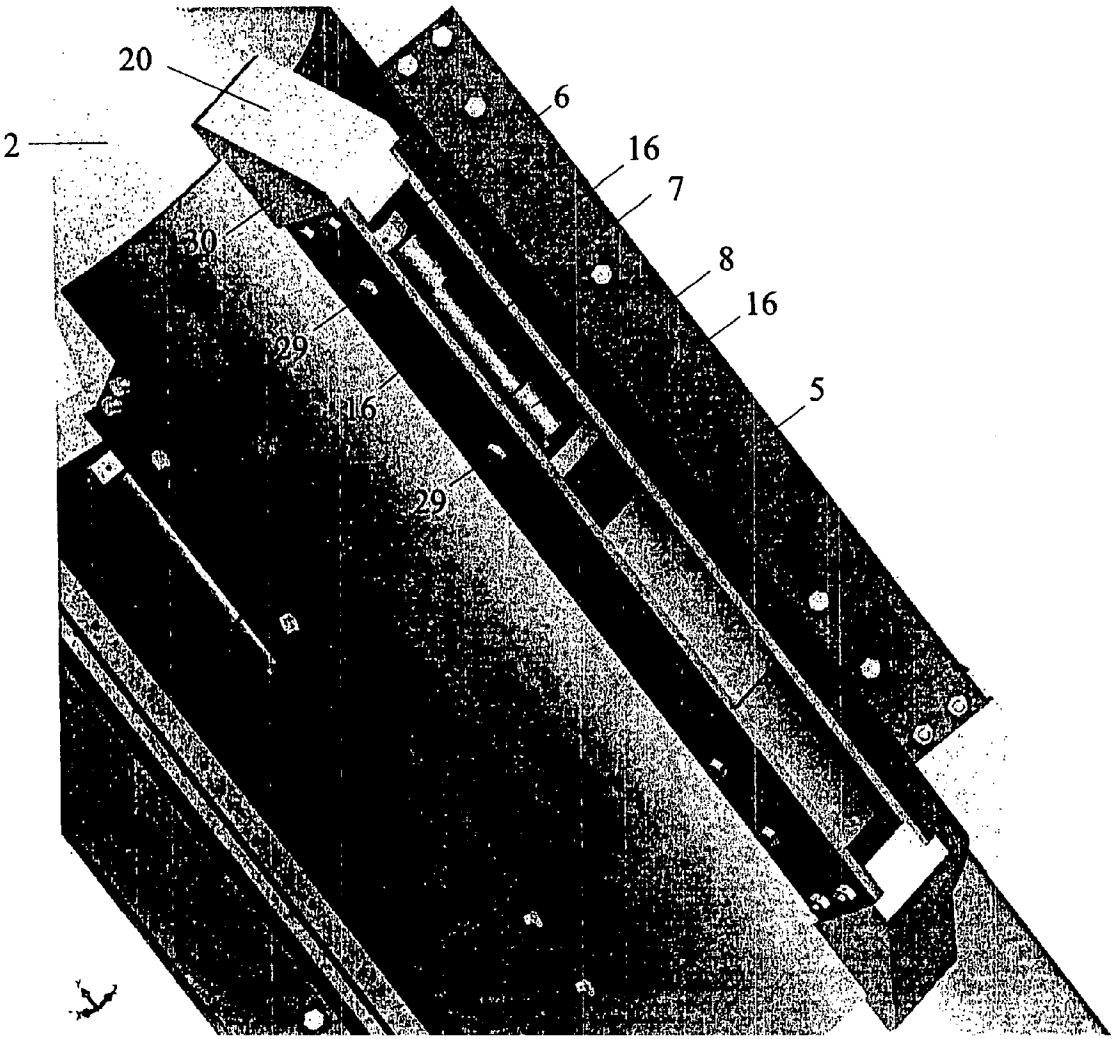
FIG. 5 is a partial perspective view showing a segment of the centralizer assembly mounted on a casing periphery.

In the subject invention, this is accomplished using a locking centralizer as generally depicted in FIGS. 1 and 5. In the preferred embodiment, the centralizer assembly consists of a clamp base assembly (5) which can be bolted in place using bolts (22) (FIG. 2) to attach the entire assembly (30) to the inner casing (2). In a typical assembly, a plurality of centralizers (30) will be attached in angularly spaced fashion around the perimeter of the casing (2) as shown in FIG. 2. This assures that the casing (2) is centered in the annular space (3) when the centralizers (30) are activated.

As best seen in FIGS. 2 and 5, the base (5) has a number of ribs (16) attached to it which allow the other centralizer components to be conveniently attached in place using, by way of example, the mounting bolts (29). A cylinder housing (7) contains an internal piston and rod (8) and a rupture device (6).

The rupture device is commercially available and may be, by way of example, a pressure relief system such as that manufactured by Continental Disc Corporation of Liberty Missouri, USA. Rupture devices are non-reclosing pressure relief devices which open within a short period of time when system pressure reaches its specific burst rating. These are more fully described in the Continental Disc Corporation Brochure No. 7-8803-7 entitled "Customized Pressure Relief Products". It should be readily understood by those skilled in the art that the rupture device utilized is one of choice and is largely dependent upon the specific application.

The component assembly is assembled at ambient pressure or near atmospheric pressure (14.7 psi) such that the pressure on each side of the piston (9) and (10) is equal.

Once assembled on the casing (2) and positioned in place within the annulus (3) of the riser (2) as shown in FIGS. 1 and 2, the pressure in the annulus (3) is increased past the burst setting pressure of the bursting device (6) (preferably about 1,500 psi). This allows fluid from the annulus to rapidly flow into the cavity behind the piston (9), and since the pressure at the other side of the piston is still at or near atmosphere, the piston moves rapidly with large force until the pressures are balanced (preferably about 90% of the cylinder stroke).

Figure 3:
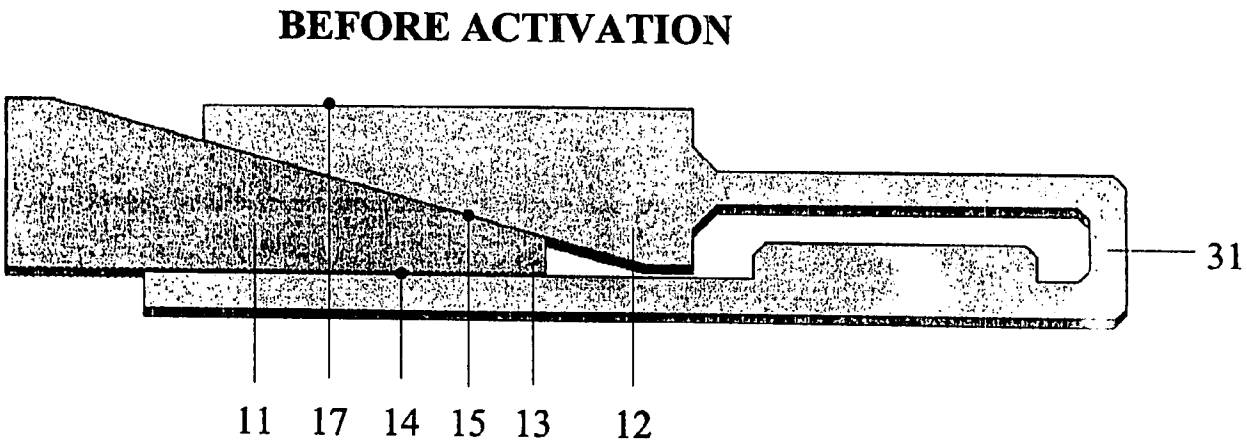
FIG. 3 is a fragmentary view looking in the same direction as FIG. 1, showing the centralizer before activation.
Figure 4:
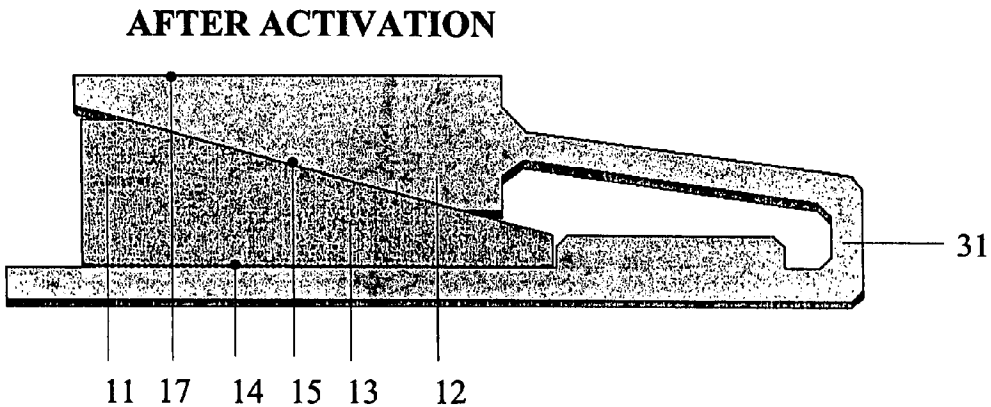
FIG. 4 is a view similar to FIG. 3 but showing the centralizer after activation.

As shown in FIGS. 3 and 4, piston activation causes the wedge (11) to be forced under the dog (12) which moves out until its outer edge (17) is in contact with the internal bore (18) of the riser (1). As best seen in FIGS. 3 and 4, the preferred embodiment includes ratchet teeth between the components at (14) and (15) such that the wedge is irreversibly locked in place, and does not revert to its original position when the annular pressure is reduced, and the piston (8) moves back away from the wedge. The dog (12) includes a live hinge (31) which permits the dog to swing outward (arrow A) toward the riser bore when the when the wedge (11) is driven axially into the dog (12) is driven by the piston (arrow B).

As shown in FIG. 2, the preferred embodiment uses an array of 6 of the centralizer assemblies (30) around the circumference of the casing (2) to ensure adequate centralization of the casing within the riser. The centralizer assemblies are capped at each end by protectors (20) preferably of a very soft metal or plastic material to help guide the assemblies through the well bore while preventing damage.

While certain features and embodiments have described in detail herein, it will be understood that the invention includes all modifications and enhancements within the scope and features of the accompanying claims.

What is claimed is:

1. A centralizer assembly for centralizing an inner tubular member inside the annulus of an outer tubular member, the assembly being mounted on the outer perimeter of the inner tubular member and comprising:

a. locking element adapted for movement between a first clearance position and a second, extended position wherein the locking element engages the outer tubular member for positioning the inner tubular member relative to the outer tubular member;

c. a driver for moving the locking element from the first clearance position to the second, extended position in response to a change in pressure in the annulus.

2. The centralizer assembly of claim 1, wherein the locking element comprises:

a. a first wedge shaped element adapted to move generally radially outward from the inner tubular member toward the outer tubular member;

b. a second wedge shaped element adapted to move generally axially along the inner tubular member and adapted for engaging the first wedge shaped element;

c. and wherein the driver is adapted for driving the second wedge shaped element in the axial direction for moving the second wedge shaped element toward the first wedge shaped element to force the second wedge shaped element into engagement with the outer tubular member.

3. The centralizer assembly of claim 1, wherein the driver is a pressure relief device responsive to drive the second wedge shaped element when the pressure in the annulus reaches a predetermined threshold.

4. The centralizer assembly of claim 2, further including ratchet teeth for engaging and locking the wedge shaped elements in position once driven by the driver.

5. The centralizer assembly of claim 3, wherein the pressure relief system is a rupture device.

6. The centralizer assembly of claim 2, including a base for holding the first wedge and second wedge shaped elements and the driver in assembled relationship.

7. The centralizer assembly of claim 6, wherein the base is adapted for carrying a plurality of the assembled relationships angularly spaced about the perimeter of the inner tubular member.

8. The centralizer assembly of claim 1, wherein the driver is a piston and cylinder assembly, wherein the piston engages and drives the locking element upon activation.

9. A centralizer assembly for centralizing casing inside a riser, the assembly being mounted on the outer perimeter of the casing and comprising:

a. locking element adapted for movement between a first clearance position and a second, extended position wherein the locking element engages the riser for positioning the casing relative to the riser;

c. a driver for moving the locking element from the first clearance position to the second, extended position in response to a change in pressure in the annulus.

10. The centralizer system of claim 9, wherein the locking element comprises:

a. a first wedge shaped element adapted to move generally radially outward from the casing toward the riser;

b. a second wedge shaped element adapted to move generally axially along the casing and adapted for engaging the first wedge shaped element;

c. and wherein the driver is adapted for driving the second wedge shaped element in the axial direction, the driver responsive to a change in pressure in the annulus.

11. The centralizer assembly of claim 9, wherein the driver is a rupture device that ruptures when the pressure in the annulus reaches a predetermined threshold.

12. The centralizer assembly of claim 10, including a base for holding the first wedge and second wedge shaped elements and the driver in assembled relationship.

13. The centralizer assembly of claim 12, wherein the base is adapted for carrying a plurality of the assembled relationships angularly spaced about the perimeter of the casing.

14. The centralizer assembly of claim 10, wherein the driver is a piston and cylinder assembly, wherein the piston engages and drives the second wedge shaped element upon activation.

15. The centralizer assembly of claim 10, further including ratchet teeth for engaging and locking the wedge shaped elements in position once driven by the driver.

16. A centralizer assembly, comprising:

a. a base;

b. a dog mounted on the base and adapted to move from a first deactivated position to a second, activated position outwardly from the base;

c. an activator in communication with the dog and adapted to move the dog from the first, deactivated position to the second, activated position when energized;

d. an energizer responsive to a change in pressure in the area around the activator for activating and the activator to move the dog from the first, deactivated position to the second, deactivated position.

17. The centralizer assembly of claim 16, wherein the dog is a wedge shaped member, and the activator is a complementary wedge shaped member, wherein axial movement of the activator will drive the dog in a perpendicular direction outward from the base.

18. The centralizer of claim 17, wherein the energizer is a piston and cylinder driver.

19. The centralizer assembly of claim 17, further including a pressure relief system in communication with the energizer, and responsive to a change in ambient pressure of the assembly to drive the piston and activator.

20. The centralizer assembly of claim 19, wherein the pressure relief system is a rupture device.

* * * * *